US005226507A

United States Patent [19]

Kawarasaki

[11] Patent Number: 5,226,507

[45] Date of Patent: Jul. 13, 1993

[54] ROPING METHOD OF AN ELEVATOR

[75] Inventor: Masashi Kawarasaki, Narashino, Japan

[73] Assignee: Otis Elevator Company, Farmington, Conn.

[21] Appl. No.: 963,775

[22] Filed: Oct. 20, 1992

[51] Int. Cl.[5] ..... B66B 11/04

[52] U.S. Cl. ..... 187/20; 254/393

[58] Field of Search ..... 187/20, 23, 24, 94, 187/1 R; 254/394, 393

[56] References Cited

U.S. PATENT DOCUMENTS 3,101,130 8/1963 Bianca ..... 187/20
4,756,388 7/1988 Heikkinen ..... 187/20
4,949,815 8/1990 Pavoz ..... 187/20
4,977,980 12/1990 Hifumi ..... 187/20

*Primary Examiner*—Robert P. Olszewski
*Assistant Examiner*—Kenneth Noland
*Attorney, Agent, or Firm*—Richard D. Getz

[57] ABSTRACT

An elevator is provided having a car, with a ceiling defined by a width and a depth, a counterweight, a plurality of ropes, a pair of first sheaves, a pair of second sheaves, and a pair of third sheaves. The car and the counterweight are connected by a plurality of ropes extending from the car to the first sheave, and then to the second sheave, then to the third sheave, and finally to the counterweight. The sheaves are positioned inside the hoistway, outside of the projected horizontal area of the ceiling of the car and therefore not directly above the ceiling in the hoistway.

2 Claims, 3 Drawing Sheets

ROPING METHOD OF AN ELEVATOR

TECHNICAL FIELD

This invention relates to elevators, and in particularly to the roping of an elevator in a hoistway.

BACKGROUND ART

Elevators typically consist of an elevator car, a counterweight, a plurality of ropes, and a sheave, all located in a hoistway. The ropes connect the elevator car and counterweight. Conventionally, one end of each rope attaches to a support frame connected to the ceiling of the car. From there the ropes extend up the hoistway to the sheave attached to overhead beams located directly above the car at the top of the hoistway. The ropes then wrap around the sheave and return back down the hoistway, finally attaching to the counterweight.

Service personnel checking or performing maintenance on this type of elevator are required to perform some of their operations on the support frame above the car. To avoid service personnel being crushed between the ceiling of the car and the overhead beams supporting the sheave, safety codes require a prescribed amount of overhead space, TC, be provided between the support frame and the overhead beam. Since the sheave is fixed to the top of the overhead beams, space is also required between the top of the overhead beams and the top of the hoistway. This space is called dead space (DS) because it is not usable space for the elevator. Finally, space is also required between the ceiling of the car and the top of the support frame (H1). This space also contributes to the unusable space in the hoistway. In sum, an elevator using this type of conventional arrangement has a minimum of unusable space equal to the sum of the code required space (TC), plus the dead space (DS), plus the space from the ceiling of the car to the top of the support frame (H1). Any space that cannot be used in a building detracts from the value of the building, and it is, therefore, desirable to minimize the unusable space.

DISCLOSURE OF THE INVENTION

It is, therefore, an object of the present invention to provide an elevator which minimizes the unusable amount of building space necessary in a hoistway.

According to the present invention, an elevator is provided having a car with a horizontal area, a counterweight, a plurality of ropes, a pair of first sheaves, a pair of second sheaves, and a pair of third sheaves. The car and the counterweight are connected by the plurality of ropes extending from the car to the first sheave, and then to the second sheave, then to the third sheave, and finally to the counterweight. The sheaves are positioned inside the hoistway, outside of the projected horizontal area of the car and therefore not above the ceiling in the hoistway.

An advantage to the roping arrangement of the present invention is that the space necessary for the sheaves at the top of the hoistway also provides the code required space for service. Placing the sheaves outside of the travel path of the elevator car enables the space to be used both for the sheaves and for the required service space thereby reducing the total amount of unusable space in the hoistway.

A further advantage of the present invention is that the roping arrangement further reduces the unusable space in the hoistway by attaching the ropes to the lower support frame of the car.

These and other objects, features and advantages of the present invention will become more apparent in light of the detailed description of the best mode embodiment thereof, as illustrated in the accompanying drawings.

BEST MODE FOR CARRYING OUT THE INVENTION

Figure 1:
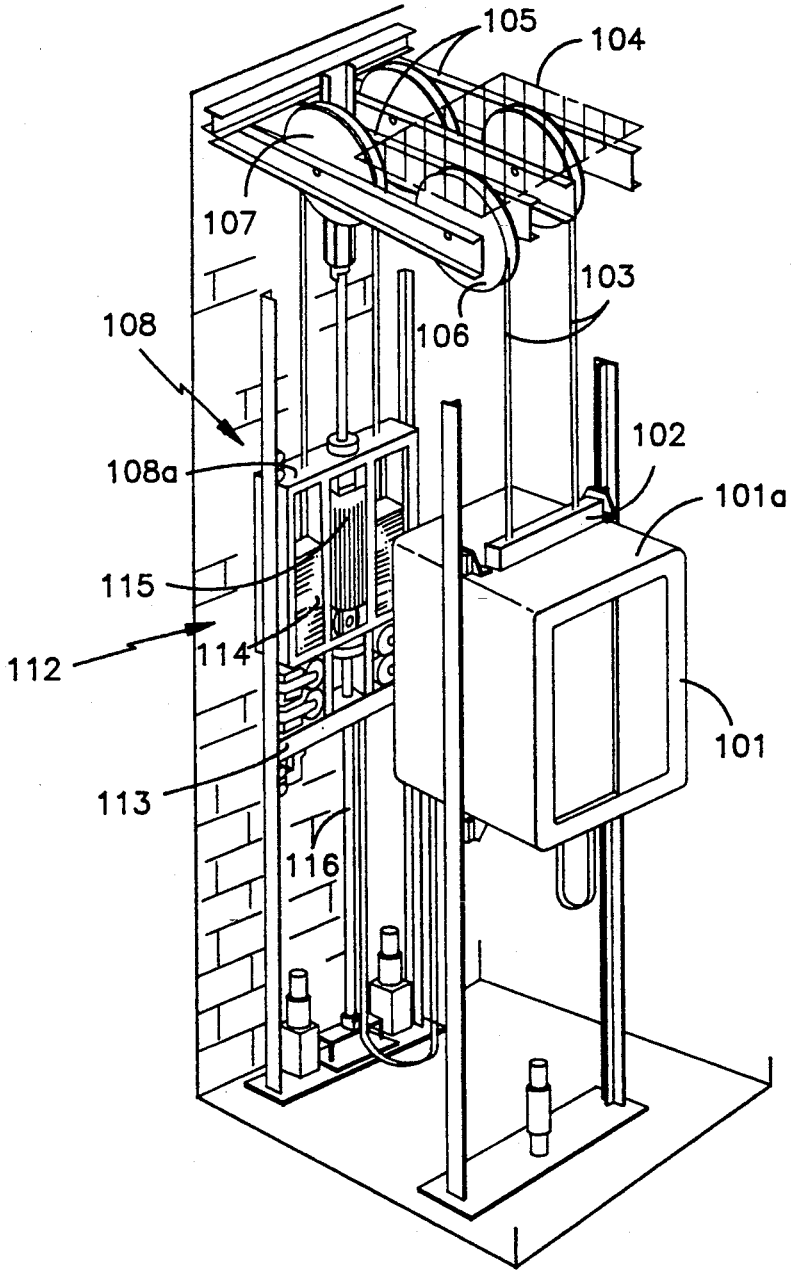
fig. 1 prior art
FIG. 1 is a diagrammatic view of the prior art method of roping the counterweight to the elevator car.
Figure 2:
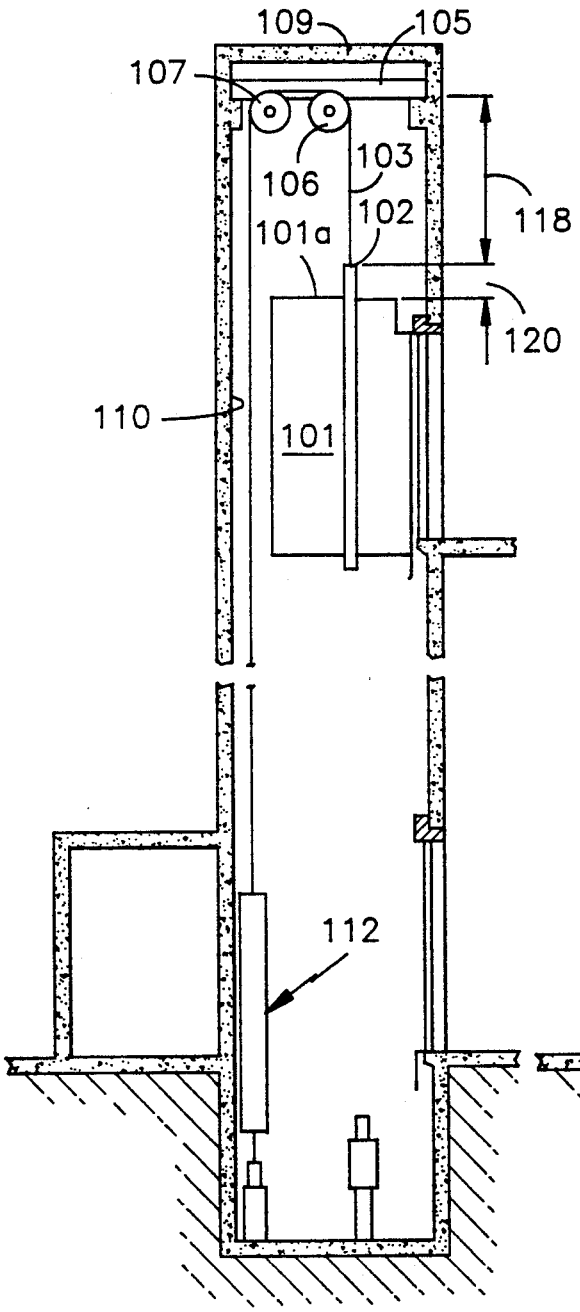
fig.2 prior art
FIG. 2 is a diagrammatic view of prior art FIG. 1 showing the elevator car and counterweight in relation to the entire hoistway.

Referring to prior art FIGS. 1 and 2, a conventional elevator is shown having an elevator car 101, a counterweight 112, a plurality of ropes 103, and a number of sheaves 106, 107, all located in a hoistway 110. The elevator car 101 has a ceiling 101*a* and a support frame 102 attached to that ceiling 101*a*. The counterweight 112 consists of a frame 113, weights 114, and the primary 108*a* of a linear motor 108. The linear motor 108 comprises the aforementioned movable primary 108*a* and a secondary 116 consisting of a ferromagnetic cylindrical column received by the primary 108*a*. The column 116 extends the length of the hoistway 110 and is attached to the hoistway 110 at the top 109 and the bottom 117 of the hoistway 110. Attractive and repulsive forces between the primary 108*a* and secondary 116 power the counterweight 112, and therefore the attached elevator car 101, up and down the hoistway 110.

One end of each rope 103 is attached to the support frame 102 attached to the ceiling 101*a* of the car 101. From there the ropes 103 extend up the hoistway 110 to the sheaves 106, 107. The sheaves 106, 107 are attached to overhead beams 105 located directly above the car 101 at the top 109 of the hoistway 110. The ropes 103 wrap around the sheaves 106, 107 and return back down the hoistway 110, finally attaching to the counterweight 112. A minimum space 118 is required between the support frame 102 and the overhead beams 105 for safety purposes. Since the sheaves 106, 107 are attached to the top of the overhead beams 105, space 119 is also required between the overhead beams 105 and the top 109 of the hoistway 110. This space is called dead space because it is not usable space for the elevator. Finally, space 120 is required between the ceiling 101*a* of the car 101 and the top of the support frame 105 attached to the car 101. This space 120 also contributes to the unusable space in the hoistway 110. An elevator using this type of conventional arrangement has, therefore, a minimum of unusable space equal to the sum of the code required space 118, plus the dead space 119, plus the space 120 from the ceiling 101*a* of the car 101 to the top of the support beam 105.

Figure 4:
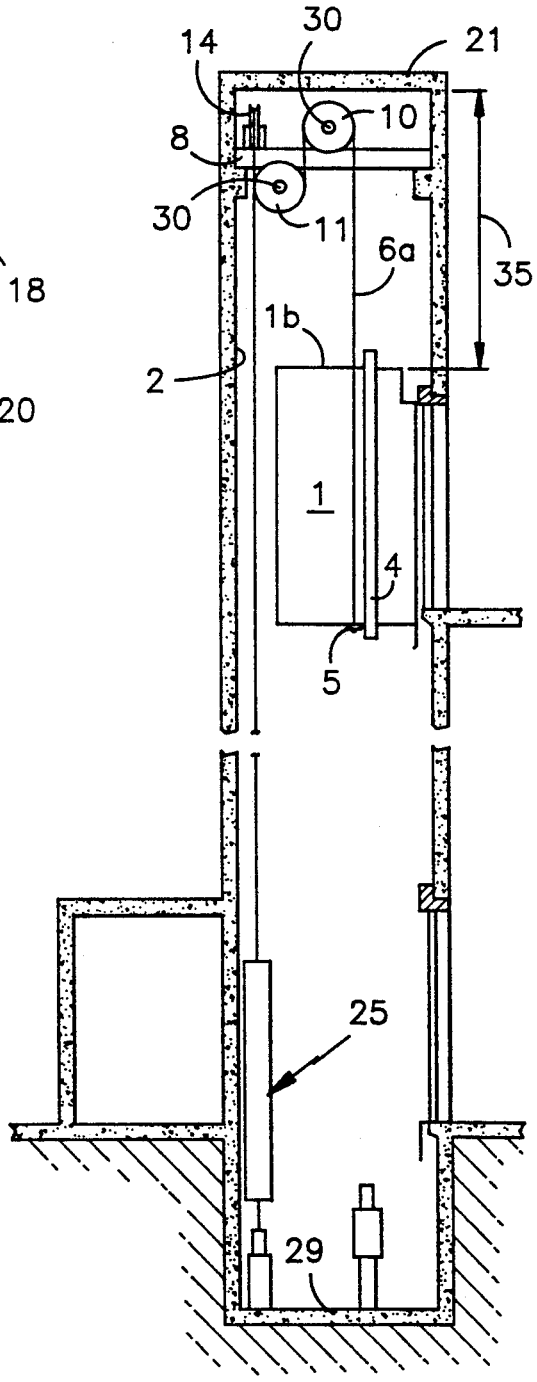
FIG. 4 is a diagrammatic view of FIG. 3 showing the elevator car and counterweight in relation to the entire hoistway.
Figure 3:
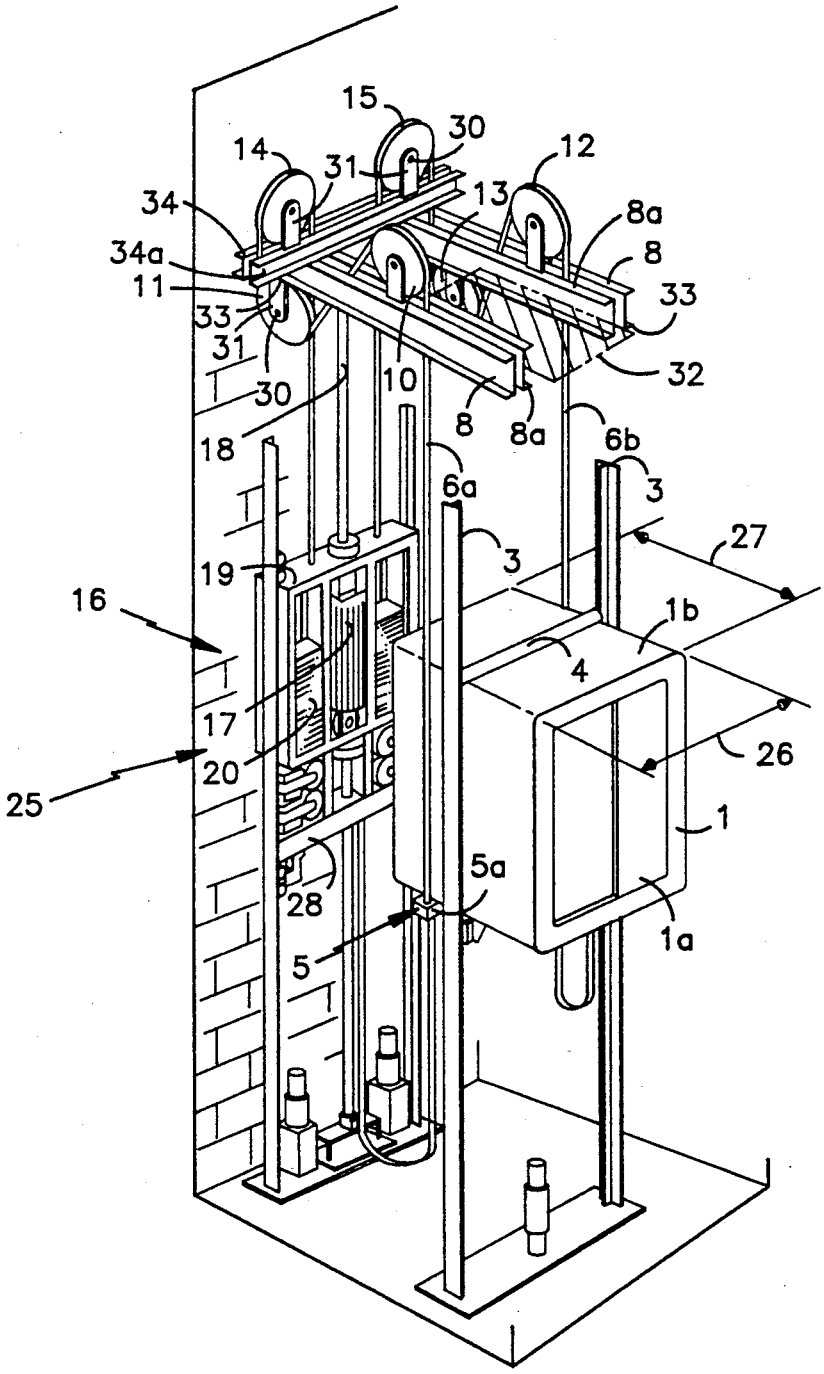
FIG. 3 is a diagrammatic view of the elevator showing the roping method of the present invention connecting the car and the counterweight by ropes outside of the projected horizontal plane of the elevator car.

Now referring to FIGS. 3 and 4, in the present invention an elevator is provided having a car 1, a counterweight 25, a pair of ropes 6*a*, 6*b*, a pair of first sheaves 10, 12, a pair of second sheaves 11, 13, and a pair of third sheaves 14, 15. The car 1 has a ceiling 1*b* whose horizontal area is defined by a width 26 and a depth 27. A support frame 4 is attached to the ceiling 1*b* of the car 1 and a suspending frame 5 is attached to the floor of the car 1. The suspending frame 5 has extensions 5*a* projecting beyond the left and right sides of the car 1, passing through the center of gravity of the car 1.

The counterweight 25 consists of a frame 28, weights 20, and the primary 17 of a linear motor 16. The linear motor 16 comprises the aforementioned movable primary 17 and a secondary 18 consisting of a ferromagnetic cylindrical column received by the primary 17. The column extends the length of the hoistway 2 and is attached to the hoistway 2 at the top 21 and the bottom 29 of the hoistway 2. The weight of the counterweight 25, including the primary 17, is set to equal the combined weight of the car 1 and the half of the weight of the rated maximum load of the elevator.

The first 10, 12, second 11, 13, and third 14, 15 pairs of sheaves are cylindrical sheaves rotatably mounted on axles 30 received by bearings (not shown) fixed to the rotational center of the sheaves. The axle 30 of each sheave is supported by a sheave bracket 31 having an arm on each side of the sheave for receiving the axle 30. Each sheave bracket 31 is attached to and supported by a pair of spaced apart structural beams 8, 8*a*.

To move the elevator car 1 up and down the hoistway 2, current is introduced into the primary 17 of the linear motor 16. Attractive and repulsive forces produced by the current passing through the primary 17 provide the motive force necessary to move the counterweight 25. Because the counterweight 25 is attached to the elevator car 1 by a pair of ropes 6*a*, 6*b* in communication with the sheaves, the car is also propelled through the hoistway 2, but in a direction opposite that of the counterweight 25.

One rope 6*a* is attached to an extension 5*a* of the suspending frame 5 projecting horizontally outward from the floor of the car on the left side of the car 1, and the other rope 6*b* is attached to an extension 5*a* of the suspending frame projecting horizontally outward from the floor of the car 1 on the right side. Each first sheave 10, 12 is mounted on a pair of spaced apart parallel structural beams 8, 8*a* at the top of the hoistway 2. The ropes 6*a*, 6*b* extending directly up from the extensions 5*a*, pass between the beams 8, 8*a* and enter the first sheaves 10, 12 centered on the beams 8, 8*a*. The ropes 6*a*, 6*b* are attached to the extensions 5*a* far enough away from the car 1 such that neither the beams 8, 8*a* nor the sheaves 10, 12 are located in the projected horizontal area 32 of the car 1. The projected horizontal area 32 of the car 1 is defined by the width 26 and the depth 27 of the car projected directly upward in the hoistway 2. An overhead beam 105 like those disclosed in the prior art (see FIGS. 1 and 2), for example, would be in the projected horizontal area 32.

Each rope 6*a*, 6*b* then wraps around the respective first sheave 10, 12 and passes back down between the structural beams 8, 8*a* to the second sheave 11, 13. Like the first sheaves 10, 12, the second sheaves 11, 13 are supported and centered on the structural beams 8, 8*a*. Unlike the first sheaves 10, 12, however, the second sheaves 11, 13 are mounted on the side 33 of the beams 8, 8*a* opposite the first sheaves 10, 12. Each rope 6*a*, 6*b* wraps around the respective second sheave 11, 13 and exits passing upward back through the respective parallel spaced apart structural beams 8, 8*a*, and is received by a third sheave 14, 15.

The third sheaves are supported by a pair of parallel, spaced apart structural beams 34, 34*a* attached to the top of the structural beams 8, 8*a* supporting the first 10, 12 and second 11, 13 sheaves outside of the space directly above the elevator car 1. The ropes 6*a*, 6*b* wrap around the third sheaves 14, 15 and exit directly above the counterweight 25 because the third sheaves 14, 15 are aligned perpendicular to the plane (not shown) containing the first 10, 12 and second sheaves 11, 13. The ropes 6*a*, 6*b* are then attached to the counterweight 25, thereby fixing the counterweight 25 and the car 1 to one another.

In sum, the roping arrangement described heretofore saves space in two significant ways. First, all of the sheaves and the structural beams supporting them are positioned outside of the projected horizontal area 32 of the car 1. Consequently, the space 35 required by code above the car 1 is inside of the beams 8, 8*a*, 34, 34*c* and sheaves 10–15 and extends up to the ceiling 21 of the hoistway 2, thereby eliminating the dead space and the space required for the overhead beams 105 (see FIGS. 1 and 2) and sheaves. Second, the ropes 6*a*, 6*b* are attached to the suspending frame 5 below the car 1. As a result, the unusable space between the ceiling 1*b* of the car 1 and the support frame 105 (see FIGS. 1 and 2) beam is eliminated.

Although this invention has been shown and described with respect to the detailed embodiments thereof, it will be understood by those skilled in the art that various changes in form and detail thereof may be made without departing from the spirit and scope of the claimed invention.

I claim:

1. An elevator comprising:

a car, having a ceiling, defined by a width and a depth, in a lower frame, for movement up and down a hoistway;

a counterweight, for movement up and down a hoistway;

a plurality of ropes each having two ends, wherein one end of each rope is connected to said lower frame of said car, and the other end is connected to said counterweight;

a pair of first sheaves, positioned in the hoistway, higher than said car;

a pair of second sheaves, positioned in the hoistway;

a pair of third sheaves, positioned in the hoistway; wherein said sheaves are positioned horizontally outside of said ceiling and therefore not above said ceiling, and wherein said ropes extend from said lower frame of said car to said first sheaves, around said first sheaves to said second sheaves around said second sheaves, to said third sheaves, around said third sheaves, and finally to said counterweight.

2. An elevator comprising:

a car, having a ceiling, defined by a width and a depth, in a lower frame, for movement up and down a hoistway;

a counterweight, comprising means for driving said counterweight, and therefore said attached car, up and down said hoistway, a plurality of ropes each having two ends, wherein one end is connected to said lower frame of said car, and the other end is connected to said counterweight;

a pair of first sheaves, positioned in the hoistway, higher than said car;

a pair of second sheaves, positioned in the hoistway;

a pair of third sheaves, positioned in the hoistway; wherein said sheaves are positioned horizontally outside of said ceiling and therefore not above said ceiling, and wherein said ropes extend from said lower frame of said car to said first sheaves, around said first sheaves to said second sheaves around said second sheaves, to said third sheaves, around said third sheaves, and finally to said counterweight.

* * * * *